US006321871B1

(12) United States Patent
Russell

(10) Patent No.: US 6,321,871 B1
(45) Date of Patent: Nov. 27, 2001

(54) ACOUSTIC PANELS AND THE LIKE

(76) Inventor: Robert Lindsay Russell, 28 Poike Road, Tauranga (NZ)

( * ) Notice: Subject to any disclaimer, the term of this patent is extended or adjusted under 35 U.S.C. 154(b) by 0 days.

(21) Appl. No.: 09/527,150

(22) Filed: Mar. 17, 2000

(30) Foreign Application Priority Data

Mar. 19, 1999 (NZ) ..... 334743

(51) Int. Cl.[7] ..... E04B 1/82
(52) U.S. Cl. ..... 181/295; 181/290
(58) Field of Search ..... 181/284, 286, 181/287, 290, 295, 30, 199, 141

(56) References Cited

U.S. PATENT DOCUMENTS 4,283,457 * 8/1981 Kolsky et al. ..... 181/290
5,968,629 * 10/1999 Matsui et al. ..... 181/290
5,975,238 * 11/1999 Fuchs et al. ..... 181/290
6,142,254 * 11/2000 Claygaugh et al. ..... 181/199

* cited by examiner

*Primary Examiner*—Khanh Dang
(74) *Attorney, Agent, or Firm*—D. Peter Hochberg; Katherine R. Vieyra; William H. Holt

(57) ABSTRACT

An acoustic panel is constructed of a rectangular frame (1). A first face of the panel is covered by a membrane (2) which is at least substantially transparent to audio frequency sound waves. The interior of the frame (1) behind the membrane (2) includes sound absorbent material (5). The second face of the panel is covered by a closure member (4) which is opaque to audio frequency sound waves.

5 Claims, 1 Drawing Sheet

ACOUSTIC PANELS AND THE LIKE

This invention relates to acoustic panels and in particular but not exclusively to sound control panels.

BACKGROUND TO THE INVENTION

An acoustic panel is generally of a standard dimension and is used in architectural situations to assist in the absorption of sound, and also in the field of sound reverberation, echo and room acoustic problems generally.

A typical acoustic panel consists of a framework which is covered on one or both faces by a decorative material. When the acoustic panel is to act as a sound absorbing panel it generally consists of a perimeter frame which can include suitable bracing and the like to rigidise the frame. A suitable sound absorbing core is positioned within the frame so that sound waves impinging on the material will be absorbed or at least attenuated. The frame is covered by a material which is intended to make the panel more aesthetically pleasing. Depending upon the usage to which the acoustic panel is to be put, the covering material on at least one face, typically the front face, is usually transparent or substantially transparent to sound waves. This will allow the sound waves to pass through the covering and be absorbed and diffused by the acoustic material. In certain circumstances where it is intended to minimise the transfer of sound through the panel, the covering material on the face of the panel which in use will be the reverse face can be formed of a material which is not transparent to sound. Any sound waves travelling through the covering material on the front face of the cover and through the sound absorbing material, will be reflected back towards the covering material on the front face. In yet another form, part of the core of the panel and/or the covering material on one or more of the faces of the panel can be composed of a sound reflective material to enable the panel to be utilised to reflect or re-direct sound waves.

The covering material is usually formed of a fabric or other suitable heavy duty material and consequently the panels are generally regarded more as a necessary adjunct rather than an architectural enhancement. It is therefore apparent that the need exists for a method of and means by which the appearance at least one visible face of the panel can be simply changed without affecting the sound absorbing or reflecting qualities of the panel.

It is known, for instance, to paint murals directly onto acoustic panels, but because of the labour intensive nature of such decoration, it is difficult for the mural or other artistic work to be removed from the panel or to be changed. In addition, because of the nature of the artistic work, considerable time can elapse between the commissioning of the work and when the panel is ready for installation. This can be a severe disadvantage if there are time constraints involved in the installation of the acoustic panels. Furthermore it can be desirable to reproduce a scene or scenes in single or multiple images onto a face of the acoustic panel or to simply preview an image to the person who may be considering ordering a particular acoustic panel. Known methods of enhancing acoustic panels in such a manner is not only time consuming but can also be expensive and consequently this type of decoration of acoustic panels is not as widely used as is desirable.

It is known particularly in architectural situations that there are many occasions when it is desirable that the decor of a room, such as a board room, should present a particular theme. For instance, an architect may wish to present or maintain a theme of historic photographs or other images in a room requiring acoustical treatment. It is apparent that being able to apply or produce an acoustic panel at least one face of which displays a photographic or computer generated or stored image can have considerable advantages. Prior to the present invention, it has not been possible to easily or satisfactorily combine these features.

OBJECT OF THE INVENTION

It is therefore an object of this invention to provide an improved form of covering for at least one of the faces of an acoustic panel.

It is also an object of this invention to provide a means for and a method of facilitating a cost effective high quality cosmetic change in the appearance of an acoustic panel.

DISCLOSURE OF THE INVENTION

Accordingly one form of the invention may be said to comprise an acoustic panel including a framework covered on at least one face by a membrane which is transparent or substantially transparent to audio frequency sound waves and on which an image is imprinted by a computer driven or an electronic printer.

Preferably the acoustic panel is a sound control panel.

Preferably the membrane is removably attached to at least one face of the panel.

Preferably the image occupies a major portion of the face of the membrane.

Preferably the image is stored in a computer processor and is printed by using a printer driven by the computer processor.

BRIEF DESCRIPTION OF THE DRAWINGS

Preferred forms of the invention will now be described with the aid of the accompanying drawings wherein.

DESCRIPTION OF PREFERRED FORMS OF THE INVENTION

Figure 1:
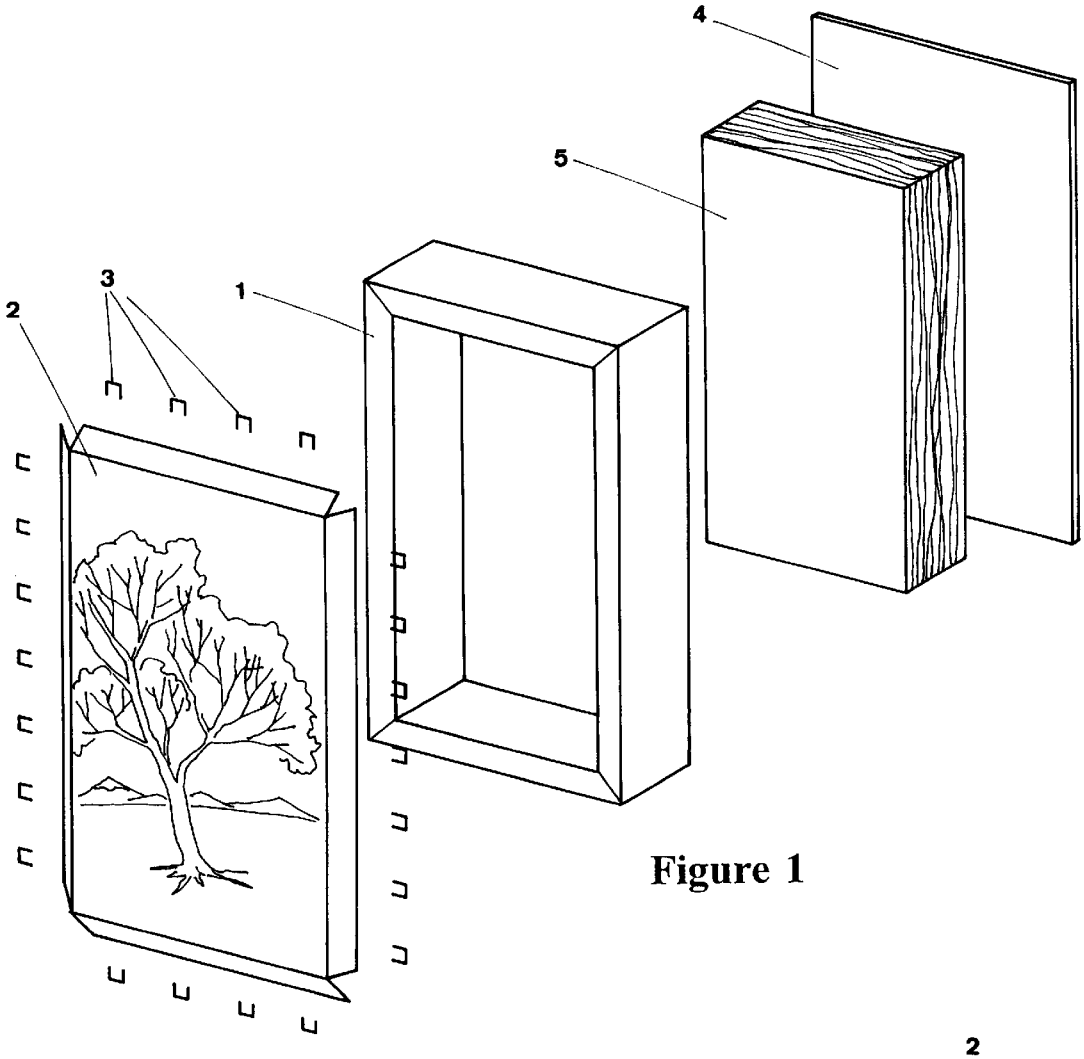
FIG. 1 is an exploded perspective view from the front of an acoustic panel according to the present invention.
Figure 2:
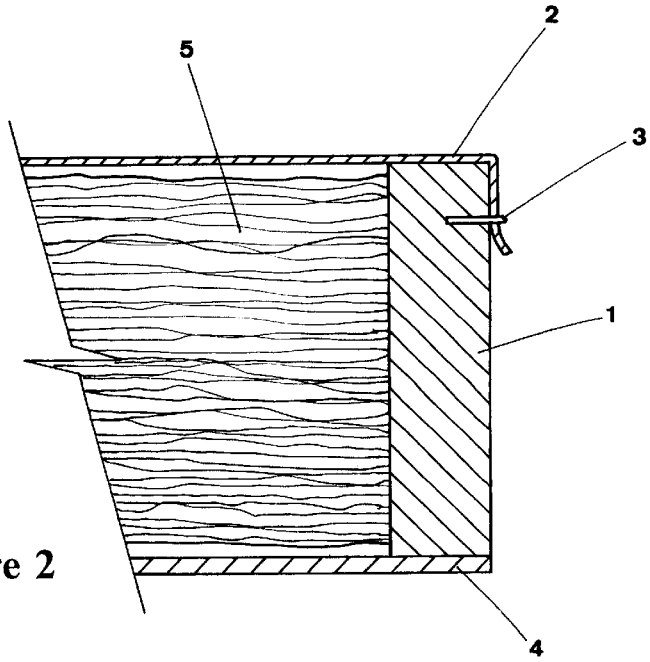
FIG. 2 is a sectional view of part of the acoustic panel illustrated in FIG. 1.

As illustrated in the drawings, a typical panel according to this invention includes a frame 1 which may be composed of lengths of timber suitably joined to form a rectangular or other desired shaped frame. A membrane 2 which may be a thin airtight canvas or similar membrane is suitably attached to one face of the frame. Various means of attaching the membrane to the acoustic panel can be utilised and in a highly preferred form as illustrated the membrane is attached to the frame of the acoustic panel by staples 3 or the like. Preferably the membrane is attached to the panel in a manner that it can be readily detached and replaced by another membrane as required.

The membrane is formed of a material that can be imprinted with an image. Preferably the image is imprinted onto the membrane by using a computer driven or electronic type printer that is capable of printing an image on a major portion of the surface of the membrane. In a highly preferred form, the image is stored or produced in a computer processor and is printed directly by means of a computer printer onto the membrane. The image can be a photographic image which has been scanned into the computer processor or it can be a computer generated image or other computer stored image or a combination of the images.

The membrane is transparent or semi-transparent to sound waves so that only a minimum impedance will be offered to sound waves intended to pass through the membrane. One highly preferred form of membrane is a thin airtight canvas which is essentially transparent to sound waves of the desired audio frequency range.

The interior of the frame is packed with or includes a suitable sound absorbent material which in the form illustrated can be a sound absorbent batt 5 as is known in the art. The reverse face of the panel can be closed by a suitable closure member 4 which can be formed of a sound absorbent or sound reflective material as required. Various means as will be apparent can be utilised to attach the closure member 4 to the frame 1.

In such a manner the panels can be utilised as an inherent part of the decoration of an area, and can also be used to emphasize particular themes. For instance in certain buildings it may be desirable to display enlarged historic photographs, or for promotional purposes to display artistic conceptualisations.

By utilizing the panels as herein disclosed, it is possible to quickly decorate an area or change the appearance of the acoustic panels and at the same time maintain control of the acoustic properties of the panels. Since acoustic panels are generally formed of a standard dimension, it is possible to quickly alter the appearance of an area, either by a repetition of the image on each panel or by successive images on adjacent panels.

Having disclosed preferred forms of the invention, it will be apparent to those skilled in the art that modifications and amendments can be made which will still come within the concept of the invention. All such modifications and amendments are intended to be included within the scope of this specification.

What is claimed is:

1. An acoustic panel comprising:

a frame having a front face and a rear face, a sound absorbing core located within the frame, a backing covering the rear face of the frame and formed of a sound absorbent or sound reflective material, and a membrane covering the front face of the frame, wherein the membrane is at least semi-transparent to sound waves and is formed from a material that will accept an image applied by a computer driven or an electronic printer, said membrane being readily removable from the front face of the frame.

2. The acoustic panel of claim 1, wherein the membrane is secured to the front face of the frame by staples which pass through the membrane and into the sides or rear of the frame.

3. The acoustic panel of claim 1, wherein the acoustic panel is a sound absorbing panel.

4. The acoustic panel of claim 1, wherein the image occupies a major portion of the face of the membrane.

5. The acoustic panel of claim 1, wherein the image is stored in a computer processor and is printed by using a printer driven by the computer processor.

* * * * *